US012220737B2

(12) United States Patent
Nishimura et al.

(10) Patent No.: US 12,220,737 B2
(45) Date of Patent: Feb. 11, 2025

(54) METHOD OF MANUFACTURING PRESS-FORMED PRODUCT AND PRESS LINE

(71) Applicant: NIPPON STEEL CORPORATION, Tokyo (JP)

(72) Inventors: Ryuichi Nishimura, Tokyo (JP); Toshiya Suzuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 221 days.

(21) Appl. No.: 17/423,668

(22) PCT Filed: Jan. 16, 2020

(86) PCT No.: PCT/JP2020/001370
§ 371 (c)(1),
(2) Date: Jul. 16, 2021

(87) PCT Pub. No.: WO2020/149380
PCT Pub. Date: Jul. 23, 2020

(65) Prior Publication Data

US 2022/0072598 A1 Mar. 10, 2022

(30) Foreign Application Priority Data

Jan. 17, 2019 (JP) ..... 2019-005940

(51) Int. Cl.
*B21D 22/20* (2006.01)
*B21C 51/00* (2006.01)
(Continued)

(52) U.S. Cl.
CPC ..... *B21D 22/20* (2013.01); *B21C 51/00* (2013.01); *B21D 24/00* (2013.01); *B21D 22/06* (2013.01); *B21D 22/22* (2013.01)

(58) Field of Classification Search
CPC ..... B21D 22/00; B21D 22/02; B21D 22/06; B21D 22/22; B21D 24/00; B21C 51/00;
(Continued)

(56) References Cited

U.S. PATENT DOCUMENTS 5,941,110 A * 8/1999 Cao ..... B21D 22/22 72/21.4
9,528,811 B2 * 12/2016 Auzinger ..... G01B 5/06 72/31.11

(Continued)

FOREIGN PATENT DOCUMENTS

EP 2311583 B1 * 12/2012 ..... B21D 5/02
GB 2041802 A * 9/1980 ..... B21D 5/02

(Continued)

*Primary Examiner* — Debra M Sullivan
*Assistant Examiner* — Matthew Stephens
(74) *Attorney, Agent, or Firm* — Birch, Stewart, Kolasch & Birch, LLP

(57) ABSTRACT

A method of manufacturing a press-formed product includes: capturing the sheet thickness of a sheet B; and using a die 6, a punch 7, and a movable mold part capable of moving relative to both the die 6 and punch 7 to press-form the sheet B into a press-formed product. During press-forming, the initial position of the movable mold part relative to the die 6 or punch 7 is controlled depending on the sheet thickness of the sheet B.

16 Claims, 9 Drawing Sheets

(51) Int. Cl.
*B21D 22/06* (2006.01)
*B21D 22/22* (2006.01)
*B21D 24/00* (2006.01)

(58) Field of Classification Search
CPC ..... B23Q 17/2452; B23Q 17/2471; G05B 2219/37398; G05B 2219/37403
USPC ..... 700/165, 206
See application file for complete search history.

(56) References Cited

U.S. PATENT DOCUMENTS

2003/0000268 A1* 1/2003 Omata ..... B21D 5/02 72/31.11
2004/0035178 A1* 2/2004 Matsumoto ..... B21D 5/0209 72/389.8
2007/0240470 A1 10/2007 Suzuki et al.
2009/0120156 A1* 5/2009 Ikeda ..... B21D 5/02 33/534
2013/0104616 A1 5/2013 Masek et al.
2015/0153148 A1* 6/2015 Angerer ..... G01B 5/24 72/31.11
2015/0224563 A1* 8/2015 Aso ..... B62D 25/08 428/595
2018/0078986 A1* 3/2018 Suzuki ..... B21D 22/26 72/31.11
2018/0104735 A1* 4/2018 Yoshikawa ..... B21D 22/26 72/31.11
2019/0176204 A1 6/2019 Suzuki et al.

FOREIGN PATENT DOCUMENTS

JP 6179696 B1 8/2017
WO WO 2005/044481 A1 5/2005

* cited by examiner

METHOD OF MANUFACTURING PRESS-FORMED PRODUCT AND PRESS LINE

TECHNICAL FIELD

The present invention relates to a method of manufacturing a press-formed product, and a press line.

BACKGROUND ART

Press-forming techniques exist that improve precision in dimensions of a press-formed product using a mold with some parts that are movable. For example, Japanese Patent No. 6179696 (Patent Document 1) discloses press equipment including a die having a die pad and a punch disposed to face the die and having an inner pad.

PRIOR ART DOCUMENTS

Patent Documents

Patent Document 1: Japanese Patent No. 6179696

SUMMARY OF THE INVENTION

Problems to be Solved by the Invention

During press-forming, all the sheets within a given manufacture lot are press-formed under pre-set press conditions. That is, if the deviation of the shape of the first press-formed product from a target shape is within a tolerance, subsequent press-forming is performed under the same press conditions as those for the first press-formed product.

In cases where a plurality of sheets have varying characteristics, the inventors noticed that, even if the press-formed product that was press-formed first has a desired shape, press-formed products that are sequentially press-formed may not have the desired shape.

In view of this, an object of the present invention is to provide a method of manufacturing a press-formed product that can reduce the deviations of the shapes of a plurality of press-formed products from a target shape, or variations therein, and a press line therefor.

Means for Solving the Problems

A method of manufacturing a press-formed product according to an embodiment of the present invention includes: capturing a sheet thickness of one or more sheets to be pressed separately for each sheet; and press-forming the sheet into a press-formed product using a die, a punch and a movable mold part, the movable mold part being capable of changing its position relative to both the die and the punch. During the press-forming, an initial position of the movable mold part relative to the die or the punch is controlled depending on the sheet thickness of the sheet.

Effects of the Invention

Embodiments of the present invention can reduce the deviations of the shapes of a plurality of press-formed products from a target shape, or variations therein.

EMBODIMENTS FOR CARRYING OUT THE INVENTION

Figure 1:
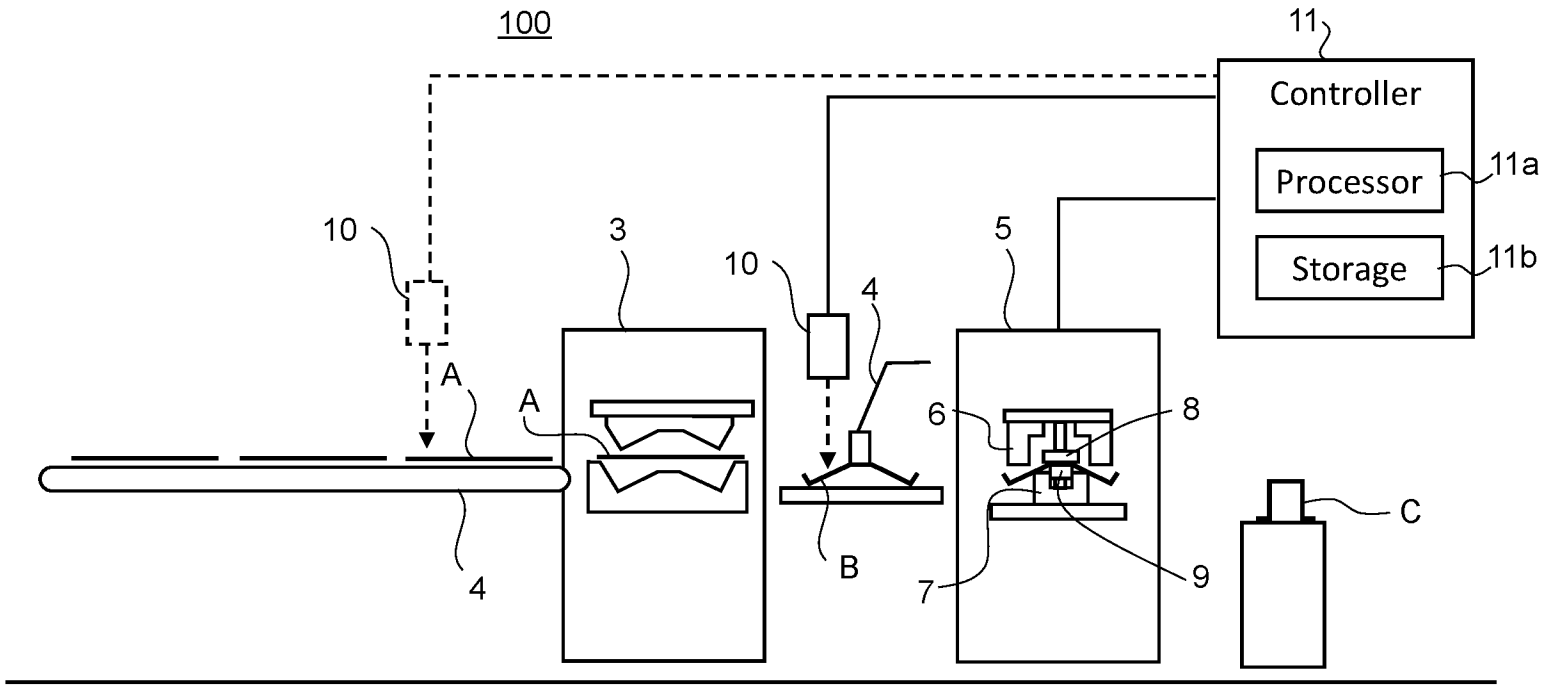
FIG. 1 shows an exemplary configuration of a press line according to an embodiment.

The inventors recognized that, if a plurality of sheets have slightly different sheet thicknesses, the shapes of the press-formed products produced by press-forming these sheets may be slightly different. In view of this, they investigated how to reduce variations in shape among press-formed products caused by variations in sheet thickness among a plurality of sheets. After intensive investigations, they found that variations in shape among press-formed products caused by variations in sheet thickness can be reduced by controlling the positions of movable mold parts relative to the die or punch depending on the sheet thickness of a sheet. Based on this finding, they arrived at the following embodiments.

(Method 1)

A method of manufacturing a press-formed product according to an embodiment of the present invention includes: capturing a sheet thickness of one or more sheets to be pressed separately for each sheet; and press-forming the sheet into a press-formed product using a die, a punch and a movable mold part, the movable mold part being capable of changing its position relative to both the die and the punch. During the press-forming, an initial position of the movable mold part relative to the die or the punch is controlled depending on the sheet thickness of the sheet.

The above manufacturing method controls the initial position of the movable mold part relative to the die or punch during press-forming depending on the sheet thickness of a sheet. Controlling the initial position adjusts the shape of the press-formed product depending on the sheet thickness of the sheet. This will reduce the deviations of the shapes of a plurality of press-formed products from a target shape or variations therein caused by variations in sheet thickness among the plurality of sheets. The sheet to be pressed may be, for example, a blank, i.e., a flat sheet, or an intermediate-formed product formed from a blank.

By way of example, the punch includes a projection protruding toward the die. The die includes a recess corresponding to the projection of the punch. The movable mold part may be provided, for example, on at least one of the projection of the punch and the recess of the die. One exemplary movable mold part, a first inner pad, is provided on the top of the projection of the punch. The first inner pad is capable of protruding from the top of the punch toward the die and also capable of being pulled into the top of the punch. Another exemplary movable mold part, a die pad, is provided on the bottom of the recess of the die. The die pad is capable of protruding from the bottom of the recess of the die toward the punch.

The initial position of the movable mold part is the position of the movable mold part relative to the die or punch at an initial stage of each of a plurality of press-forming cycles. For each press-forming cycle, with the movable mold part at the initial position being in contact with the sheet, the die and punch are moved closer to each other to perform press-forming. The initial position of the movable mold part is the position of the movable mold part before the act of moving the die and punch closer to each other.

For example, during press-forming, the movable mold part may be in contact with a portion of the sheet that is to be the relevant portion of the press-formed product (i.e., finished product). In such implementations, the movable mold part controls the shape of the relevant portion of the press-formed product (i.e., finished product). Adjusting the initial position of the movable mold part fine-tunes the shape of the relevant portion of the press-formed product.

The movable mold part may be capable of moving relative to the die or punch during one press-forming cycle. Examples of movable mold parts of this type include punch pads (i.e., inner pads), die pads, and blank holders. Alternatively, the position of the movable mold part relative to the die or punch may be fixed throughout one press-forming cycle. That is, the movable mold part may be incapable of moving (i.e., operating) relative to the die or punch during one press-forming cycle. One press-forming cycle is a press-forming cycle performed by one set of die, punch and movable mold part to fabricate one press-formed product.

(Method 2)

Starting from Method 1 above, the press-forming may include successively press-forming a plurality of sheets. During at least one of the plurality of successive press-forming cycles, the initial position of the movable mold part relative to the die or the punch may be controlled depending on the sheet thickness of the sheet. This will reduce variations in shape among a plurality of press-formed products fabricated by a plurality of successive press-forming cycles caused by variations in sheet thicknesses.

(Method 3)

Starting from Method 1 or 2 above, the capturing of the sheet thickness may include capturing sheet thicknesses at a plurality of positions on one sheet. During the press-forming of the one sheet, the initial position of the movable mold part relative to the die or the punch may be controlled depending on the sheet thicknesses at the plurality on positions of the one sheet. In this way, the differences in sheet thickness within one sheet may be reflected in the initial position of the movable mold part. This will reduce the deviation of the shape of a press-formed product from a target shape or variations therein caused by differences in sheet thickness within one sheet.

(Method 4)

Starting from Method 3 above, the movable mold part may include a plurality of movable mold parts capable of changing their positions independently from each other. The capturing of the sheet thickness may include capturing sheet thicknesses at a plurality of positions on one sheet corresponding to the plurality of movable mold parts. During the press-forming of the one sheet, the initial positions of the plurality of movable mold parts may be controlled depending on the sheet thicknesses of the one sheet at the corresponding ones of the plurality of positions. In this way, the initial positions of the movable mold parts corresponding to the positions on the sheet for which sheet thicknesses have been captured can be controlled depending on these sheet thicknesses. This will allow the differences in sheet thickness within one sheet to be more finely reflected at the movable mold parts.

(Method 5)

Starting from any one of Methods 1 to 4 above, during the press-forming, a portion of the sheet for which the sheet thickness has been measured may slide against the die. The inventors found that the sheet thicknesses of portions of a sheet that slide against the die during press-forming are particularly likely to affect the shape of the press-formed product. According to Method 5 above, the sheet thicknesses of portions of the sheet that slide against the die are measured and the initial positions of the movable mold parts are controlled depending on the measured sheet thicknesses. Thus, the initial positions of the movable mold parts can be controlled depending on the sheet thicknesses of sheet portions that are particularly likely to affect the shape of the press-formed product. This will further reduce variations in shape among a plurality of press-formed products.

(Method 6)

Starting from Method 5 above, the movable mold part may include a first inner pad provided on a top of the punch. A position on the sheet for which the sheet thickness has been measured may be located in a cross section perpendicular to a ridge of a punch corner (punch shoulder) of the punch and containing the first inner pad during the press-forming.

Method 6 enables controlling the amount of stick-out of the first inner pad from the punch depending on the sheet thicknesses of portions of the sheet that are even more particularly likely to affect the shape of the press-formed product. This will further reduce variations in shape among a plurality of press-formed products.

(Method 7)

Starting from Method 5 above, the movable mold part may include a first inner pad and a second inner pad provided on a top of the punch. The sheet may be a differential-thickness metal sheet including a thick portion and a thin portion having a smaller sheet thickness than the thick portion. The capturing of the sheet thickness of the sheet may include capturing a sheet thickness of the thick portion and a sheet thickness of the thin portion. A position on the thick portion for which sheet thickness has been captured may be located in a cross section perpendicular to a ridge of a punch corner (punch shoulder) of the punch and containing the first inner pad during the press-forming, and a position on the thin portion for which sheet thickness has been captured may be located in a cross section perpendicular to the ridge of the punch corner and containing the second inner pad during the press-forming. In such implementations, during the press-forming, the initial position of the first inner pad relative to the punch can be controlled depending on the sheet thickness of the thick portion, and the initial position of the second inner pad relative to the punch can be controlled depending on the sheet thickness of the thin portion.

According to Method 7 above, during press-forming of a sheet having a thick portion and a thin portion, the initial positions of the first and second inner pads relative to the punch can be controlled depending on the sheet thicknesses of portions of the sheet that are even more particularly likely to affect the shape of the press-formed product.

(Method 8)

Starting from Method 5 above, the movable mold part may include a first inner pad and a second inner pad provided on a top of the punch. The sheet may include a high-strength portion and a low-strength portion having a lower strength than the high-strength portion. The capturing of the sheet thickness of the sheet may include capturing a sheet thickness of the high-strength portion and a sheet thickness of the low-strength portion. A position on the sheet for which a sheet thickness of the high-strength portion has been captured may be located in a cross section perpendicular to a ridge of a punch corner of the punch and containing the first inner pad during the press-forming, and a position on the sheet for which a sheet thickness of the low-strength portion has been captured may be located in a cross section perpendicular to the ridge of the punch corner and containing the second inner pad during the press-forming. In such implementations, during the press-forming, the initial position of the first inner pad relative to the punch may be controlled depending on the sheet thickness of the high-strength portion, and the initial position of the second inner pad relative to the punch may be controlled depending on the sheet thickness of the low-strength portion.

According to Method 8 above, during press-forming of a sheet with high- and low-strength portions, the initial positions of the first and second inner pads relative to the punch may be controlled depending on the sheet thicknesses of portions of the sheet that are even more particularly likely to affect the shape of the press-formed product.

(Method 9)

Starting from any one of Methods 1 to 8 above, the press-forming may include: a first press step in which, with a position of the movable mold part relative to the die or the punch being fixed to the initial position, the die and the punch are moved closer to each other to press-form the sheet; and a second press step in which, while the movable mold part is being pulled into the die or the punch, the die and the punch are moved closer to each other to press-form the sheet. During the press-forming, the initial position of the movable mold part may be controlled depending on the sheet thickness of the sheet.

The inventors found that the initial position of the movable mold part during the first press step, in which the position of the movable mold part relative to the die or the punch is fixed at an initial position and the die and punch are moved closer to each other to press-form the sheet, affects the shape of the press-formed product more significantly. According to Method 9 above, the initial position of the movable mold part during the first press step can be controlled depending on the sheet thickness of the sheet. This will further reduce variations in shape among a plurality of press-formed products.

In Method 9 above, the portion of the sheet for which the sheet thickness has been captured and the die may slide against each other during at least one of the first and second press steps. This will enable controlling the initial position of the movable mold part depending on the sheet thicknesses of portions of the sheet that are particularly likely to affect the shape of the press-formed product.

In any one of Methods 1 to 9, the initial position of the movable mold part that can be controlled depending on the sheet thickness of the sheet may be the amount(s) of stick-out, from the punch, of the first and/or second inner pad(s) on the top of the punch, for example. The amount(s) of stick-out may be the amount(s) of protrusion of the first and/or second inner pad(s) from the punch, for example. This will enable efficiently controlling variations in shape among a plurality of press-formed products.

(Method 10)

Starting from any one of Methods 1 to 9 above, a portion of the sheet with the highest strength may have a tensile strength not lower than 980 MPa. The inventors have found that a sheet having a high strength not lower than 980 MPa may have larger variations in sheet thickness than a low-strength sheet. Applying any one of Methods 1 to 9 above to a sheet with a strength not lower than 980 MPa will enable press-forming such a high-strength sheet with reduced deviation of the press-formed product from a target shape or reduced variations therein. The sheet may be a metal sheet. By way of example, the sheet may be a steel sheet.

A method of manufacturing a press-formed product according to another embodiment of the present invention includes: measuring a sheet thickness of a sheet to be pressed; and press-forming the sheet into a press-formed product using a die and a punch including a first inner pad on its top. The press-forming controls an amount of stick-out of the first inner pad from the punch depending on the sheet thickness of the sheet.

(Arrangement 1)

A press line according to an embodiment of the present invention includes: a sheet-thickness capturing device adapted to capture a sheet thickness of one or more sheets to be pressed separately for each sheet; press equipment including a die, a punch and a movable mold part capable of moving relative to both the punch and the die; and a controller adapted to control the press equipment. The controller is adapted, during press-forming of the sheet by the die, the punch and the mold part, to control an initial position of the movable mold part relative to the die or the punch depending on the sheet thickness of the sheet captured by the sheet-thickness capturing device.

With Arrangement 1 above, the initial position of the movable mold part relative to the die or punch during press-forming of each sheet is controlled depending on the sheet thickness of that sheet on an individual basis. Controlling the initial position in this manner adjusts the shape of a press-formed product depending on the sheet thickness of the sheet. This will reduce the deviations of the shapes of a plurality of press-formed products from a target shape or variations therein caused by variations in sheet thickness among a plurality of sheets.

(Arrangement 2)

Starting from Arrangement 1 above, the sheet-thickness capturing device may be a sheet-thickness measurement device adapted to measure the sheet thickness of the sheet. This will enable efficiently capturing sheet thickness separately for each sheet to be pressed.

(Arrangement 3)

Starting from Arrangement 2 above, a position on the sheet for which the sheet thickness is measured by the sheet-thickness measurement device may be located in a plane perpendicular to a ridge of a punch corner of the punch and containing the movable mold part. This will enable controlling the initial position of that movable mold part which corresponds to the position on the sheet for which sheet thickness has been measured.

(Arrangement 4)

A press line according to an embodiment of the present invention includes: press equipment including a die, a punch, and a movable mold part capable of moving relative to both the die and the punch; a sheet-thickness measurement device; a transportation device capable of transporting the sheet to be pressed from the sheet-thickness measurement device to the press equipment; and a controller connected to the sheet-thickness measurement device and the press equipment. The movable mold part and the sheet-thickness measurement device are located on a line extending in a direction of transportation of the transportation device.

As used in Arrangement 4 above, the movable mold part and the sheet-thickness measurement device being located on a line extending in the direction of transportation means that the position on a sheet for which measurement is done by the sheet-thickness measurement device and the movable mold part are arranged on a line extending in the direction of transportation. This arrangement will enable measuring the sheet thickness of a region of the sheet that spreads in the direction of transportation from the portion of the sheet that is to be contacted by the movable mold part during press-forming by the press equipment. Since the controller is connected to the sheet-thickness measurement device and press equipment, it can control the initial position of the movable mold part relative to the die or punch during press-forming by the press equipment using the sheet thickness measured by the sheet-thickness measurement device. The controller can control the initial position of the movable mold part during press-forming depending on the sheet thickness of a portion of the sheet that is particularly likely to affect the shape of the press-formed product. This will reduce the deviations of the shapes of a plurality of press-formed products from a target shape or variations therein caused by variations in sheet thickness among a plurality of sheets.

The sheet thickness measurement device is configured to be capable of measuring the sheet thickness of a sheet being transported at a location that is upstream of the press equipment. The controller controls the initial position of the movable mold part relative to the die or punch during press-forming of a sheet depending on the sheet thickness of the sheet measured by the sheet-thickness measurement device. For example, where the position of the movable mold part relative to the die or punch (for example, amount of protrusion) is fixed at an initial position and, in this state, the die and punch are moved closer to press-form the sheet, the controller may decide the initial position based on sheet thickness.

The controller may include a processor and a storage device. The processor executes a program stored on the storage device. The program may be a program that causes the processor to perform a process of controlling the initial position of the movable mold part relative to the die or punch during press-forming of a sheet depending on the sheet thickness of the sheet measured by the sheet-thickness measurement device.

(Arrangement 5)

Starting from Arrangement 4, the sheet-thickness measurement device may be configured to measure sheet thicknesses at a first position and a second position. The movable mold part may include a first inner pad and a second inner pad provided on a top of the punch. The first inner pad and the first position may be located on a line extending in the direction of transportation of the transportation device. The second inner pad and the second position may be located on a line extending in the direction of transportation of the transportation device.

In Arrangement 5 above, the first position on the sheet at which measurement is done by one of a plurality of sheet-thickness measurement devices and the first inner pad are arranged on a line extending in the direction of transportation, whereas the second position and the second inner pad are arranged on a line extending in the direction of transportation. This will enable controlling the first and second inner pads corresponding to a plurality of measurement positions on the sheet depending on the sheet thicknesses at the respective measurement positions.

EMBODIMENTS (Press Line)

FIG. 1 shows an exemplary configuration of a press line 100 according to an embodiment. The press line 100 shown in FIG. 1 includes a transportation device 4, intermediate-forming press equipment 3, press equipment 5, a sheet-thickness measurement device 10, and a controller 11. The sheet-thickness measurement device 10 is located upstream of the press equipment 5. The sheet-thickness measurement device 10 measures the sheet thickness of a sheet B that is to be pressed by the press equipment 5. The transportation device 4 transports a blank A to the intermediate-forming press equipment 3. The transportation device 4 also transports the sheet B away from the sheet-thickness measurement device 10 to the press equipment 5. That is, the transportation device 4 transports the sheet from a location at which the sheet-thickness measurement device 10 measures the sheet thickness of the sheet to the press equipment 5.

The transportation device 4 may be, for example, a conveyor including a transportation route leading to the press equipment 5. In such implementations, the transportation route of the transportation device 4 is positioned to pass through the measurement region for of the sheet-thickness measurement device 10. The transportation device 4 is not limited to a conveyor. For example, the transportation device 4 may be a manipulator constituted by an articulated robot. In such implementations, the manipulator transports a sheet placed on a material table, or on a mold, positioned upstream of the press equipment 5 to the press equipment 5. The sheet-thickness measurement device 10 is positioned to be capable of measuring the sheet thickness of a sheet being transported on a material table or by a manipulator. Alternatively, the transportation device 4 may be an unmanned or manned forklift.

The location at which the sheet-thickness measurement device 10 measures the sheet thickness of the sheet 1 is not limited to that illustrated in FIG. 1. The sheet-thickness measurement device 10 measures the sheet thickness of a sheet that is yet to be press-formed by the press equipment 5. For example, the sheet thickness of a sheet may be measured, rather than on the transportation device 4, in the intermediate-forming press equipment 3 or press equipment 5.

The press equipment 5 press-forms the sheet B into a press-formed product C. The press equipment 5 includes a mold constituted by a die 6, a punch 7, a die pad 8, and a punch inner pad 9. The die pad 8 and punch inner pad 9 are capable of changing their positions relative to both the die 6 and punch 7. The press equipment 5 places the sheet B between the die 6 and punch 7 and pushes the sheet B by means of both the die 6 and punch 7 to press-form the sheet B.

Specifically, the press equipment 5 press-forms the sheet B by means of the die 6 and punch 7 while moving the die 6 and punch 7 relative to each other to push the punch 7 into the interior of the die 6. A press-forming process for producing one press-formed product includes a step in which, with the punch inner pad 9 being in contact with the sheet B and the position of the punch inner pad relative to the punch 7 fixed at a set position (i.e., initial position), the die 6 and punch 7 are moved closer to each other such that the die 6 and punch 7 push the sheet B (i.e., first press step). Further, the press-forming process includes a step in which, while the punch inner pad 9 is being pulled into the punch 7, the die 6 and punch 7 are moved closer to each other to press-form the sheet (i.e., second press step).

The sheet-thickness measurement device 10 measures the sheet thickness of the sheet to be pressed. The sheet to be pressed may be, for example, a blank that is yet to be press-formed by the press equipment 5, or an intermediate-formed product. FIG. 1 shows an exemplary device that measures the sheet thickness of the intermediate-formed product B. The implementation in FIG. 1 may be modified by omitting the intermediate-forming press equipment 3. In such implementations, the sheet-thickness measurement device 10 measures the sheet thickness of the blank A.

The sheet-thickness measurement device 10 may be configured, for example, to measure the sheet thickness of a sheet using an optical sensor against a side of the sheet. Alternatively, the sheet-thickness measurement device 10 may be configured to measure the sheet thickness of a sheet by, for example, using a laser displacement meter against each of the front and back faces of the sheet to measure its shape. The sheet-thickness measurement device 10 may measure, for example, the thickness of the sheet in the direction of the normal to its surface and treat it as the sheet thickness of the sheet. The measurement by the sheet-thickness measurement device 10 is not limited to any particular manner. In other implementations, for example, the distance between each of the front and back faces of a sheet, on one hand, and an eddy current meter, on the other, may be measured to enable indirect measurement of the sheet thickness.

The controller 11 is connected to the press equipment 5 and sheet-thickness measurement device 10. The controller 11 may be connected to the press equipment 5 and sheet-thickness measurement device 10 via a cable, or may be wirelessly connected. The controller 11 is capable of communicating with the press equipment 5 and sheet-thickness measurement device 10. The controller 11 may be incorporated into the press equipment 5 or sheet-thickness measurement device 10, or may be an independent device.

The controller 11 may be constituted by, for example, a computer including a processor 11*a* and a storage device 11*b* (i.e., memory). The processor 11*a* is capable of performing the following functions of the controller 11 by executing a program stored on the storage device 11*b*. The controller 11 uses data relating to the sheet thickness of a sheet measured by the sheet-thickness measurement device 10 to control the position of the die pad 8 or punch inner pad 9 relative to the die 6 or punch 7 during press-forming. Specifically, the controller 11 sets the position of the die pad 8 or punch inner pad 9 relative to the die 6 or punch 7 based on data relating to the sheet thickness of a sheet measured by the sheet-thickness measurement device 10.

The relative position set by the controller 11 may be, for example, a set amount at which the amount of stick-out of the punch inner pad 9 from the punch 7 is fixed (i.e., initial position), where, with that state kept, the die 6 and punch 7 are moved closer to each other for press-forming (i.e., first press step, discussed above). That is, the set amount for the first press step is controlled by the controller 11.

The controller 11 may use, for example, correspondence data, stored on the storage device 11*b* in advance, indicating the correspondence between a sheet thickness and the initial position of the movable mold part relative to the die or punch (for example, amount of stick-out of the punch inner pad from the punch) to determine the initial position of the movable mold part (i.e., amount of stick-out of the punch inner pad from the punch) that corresponds to a sheet thickness measured. The correspondence data indicates the correspondence between the initial position of the movable mold part (i.e., amount of stick-out of the punch inner pad 9 from the punch 7) during press-forming (for example, during the first press step), on one hand, and the sheet thickness of a sheet, on the other. Specifically, the correspondence data may indicate the correspondence between a value indicating the sheet thickness of a sheet obtained by measurement, on one hand, and a value for controlling the initial position of the movable mold part during press-forming (i.e., amount of stick-out of the punch inner pad 9 from the punch 7). The correspondence data is not limited to any particular data format. The correspondence data may be data (e.g., table data or map data) for associating a value indicating the sheet thickness of a sheet with a value for controlling the movable mold part (i.e., punch inner pad 9). Alternatively, the correspondence data may be data (e.g., functions, programs or parameters therefor) indicating a procedure for the processor for calculating values for controlling the initial position of the movable mold part (i.e., amount of stick-out of the punch inner pad from the punch) using values indicating the sheet thickness of a sheet. The correspondence data may be created, for example, based on the sheet thicknesses of a plurality of sheets that have been previously measured, the initial positions of the movable mold part during press-forming of those sheets, and the shapes of the press-formed products obtained from those press-forming cycles.

For example, the controller 11 may obtain, from the sheet-thickness measurement device 10, data indicating the sheet thickness of a sheet. The controller 11 uses the correspondence data to convert values indicating the sheet thickness of a sheet to control values indicating the initial position of the movable mold part relative to the die or punch (i.e., amount of stick-out of the punch inner pad 9 from the punch 7). The controller 11 controls the press equipment 5 in such a manner that the initial position of the movable mold part during press-forming (i.e., amount of stick-out of the punch inner pad 9 from the punch 7) matches the amount of stick-out indicated by the control values.

The press equipment 5 manufactures a plurality of press-formed products by, for example, press-forming a plurality of sheets B contained in a manufacture lot in a repetitive manner. The controller 11 may set the initial position of the movable mold part (i.e., amount of stick-out of the punch inner pad 9 form the punch 7) for each of the sheets to be press-formed. To set the initial position of the movable mold part (i.e., amount of stick-out of the punch inner pad 9 from the punch 7) for one particular sheet B to be press-formed, the controller 11 uses data indicating the sheet thickness of this particular sheet B. This enables feedforward control of the initial position of the movable mold part (i.e., amount of stick-out of the punch inner pad 9 from the punch 7) depending on the sheet thickness of a sheet.

(Exemplary Configuration of Press Equipment and Sheet-Thickness Measurement Device)

Figure 2:
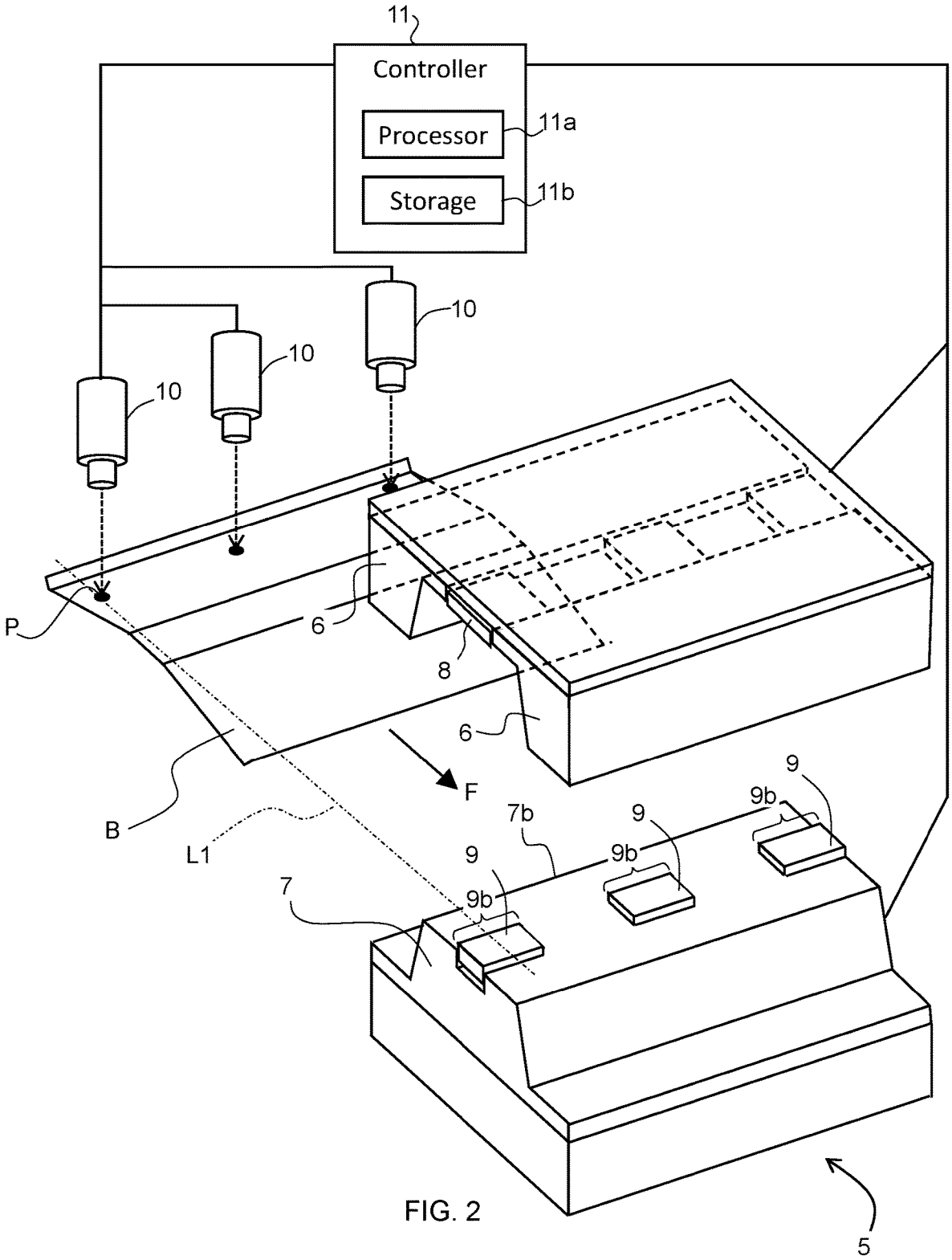
FIG. 2 is a perspective view of an exemplary configuration of press equipment having movable mold parts.

FIG. 2 is a perspective view of an exemplary configuration of press equipment 5 having movable mold parts. In the implementation shown in FIG. 2, the mold having movable parts includes: a die 6 having a recess; a punch 7 having a projection corresponding to the recess of the die 6; and a die pad 8 and a punch inner pad 9 capable of moving relative to the die 6 and punch 7. The die pad 8 forms part of the recess of the die 6, and is capable of protruding from the recess of the die 6 toward the punch 7. The punch inner pad 9 forms part of the projection of the punch 7, and is capable of protruding from the projection of the punch 7 toward the die 6.

The sheet B is transported between the die 6 and punch 7. The direction of transportation of the sheet B, F, is generally perpendicular to the direction of extension of a ridge 7*b* of the projection of the punch 7. The ridge 7*b* of the projection of the punch 7 is in contact with the sheet B during press-forming. The ridge 7*b* of the projection of the punch 7 is the ridge of a punch corner. In the implementation shown in FIG. 2, a plurality of punch inner pads 9 are provided. The punch inner pads 9 are arranged in the direction perpendicular to the direction of transportation of the sheet, spaced apart from one another. In other words, a plurality of punch inner pads 9 are arranged in the direction of extension of the ridge 7*b* of the projection of the punch 7, spaced apart from one another. The direction of a ridge 9*b* of the punch inner pad 9 is the same as the direction of the ridge 7*b* of the projection of the punch 7. In this implementation, a punch inner pad 9 extends part of the dimension, rather than the entire dimension, of the punch 7 as measured in the direction perpendicular to the direction of transportation. Arbitrary two of the plurality of punch inner pads 9 constitute examples of the first and second inner pads. Further, the first and second inner pads constitute examples of the plurality of movable mold parts.

A plurality of die pads 8 are provided. The die pads 8 are located at positions corresponding to the respective punch inner pad 9. The die pads 8 are arranged in the direction perpendicular to the direction of transportation of the sheet, spaced apart from each other. A die pad 8 extends part of the dimension, rather than the entire dimension, of the die 6 as measured in the direction perpendicular to the direction of transportation.

Figure 3A:
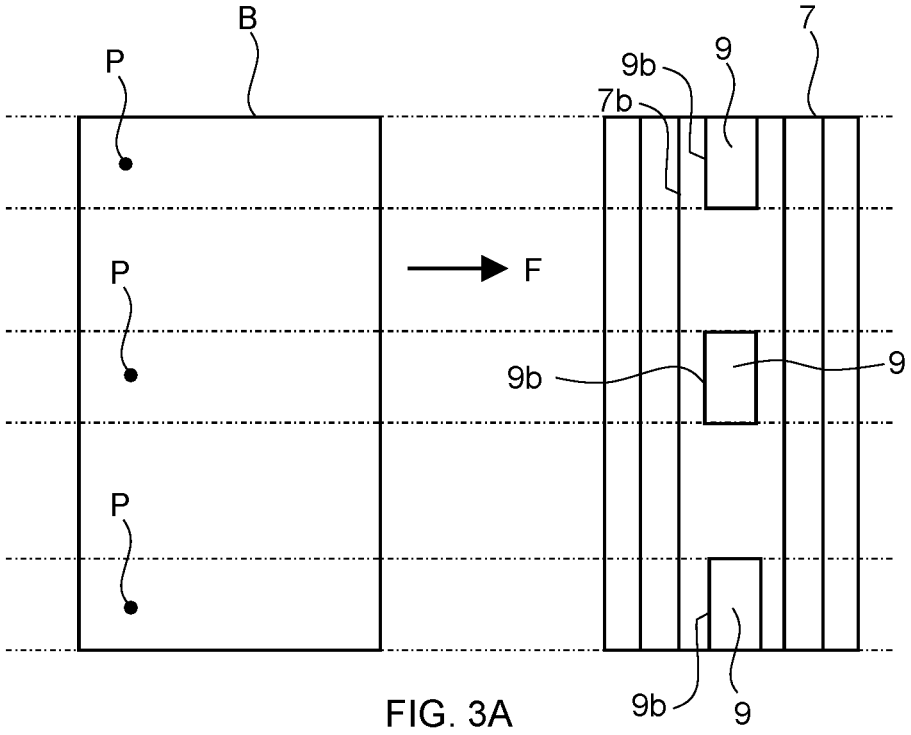
FIG. 3A shows an exemplary arrangement of the punch and sheet.

In the implementation shown in FIG. 2, a punch inner pad 9 and the associated sheet-thickness measurement device 10 are located on a line L1 extending in the direction of transportation F of the sheet. That is, the measurement position P for a sheet-thickness measurement device 10 and the associated punch inner pad 9 are located on a line L1 extending in the direction of transportation F. FIG. 3A shows an exemplary arrangement of the punch 7 and sheet B as viewed from above. As shown in FIG. 3A, the measurement position P for a sheet-thickness measurement device 10 is located in a region in an upstream extension, in the direction of transportation, of the associated punch inner pad 9. In other words, a movable part (i.e., punch inner pad) 9 and the associated sheet-thickness measurement position P on the sheet B are arranged in the direction in which the sheet is drawn into the mold.

In the arrangement shown in FIG. 2, a cross section perpendicular to the ridge 7*b* of the punch corner of the punch 7 and containing each of the punch inner pads 9 contains the respective one of the positions on the sheet B at which sheet thickness has been measured. The ridge 7*b* of a punch corner of the punch 7 is the ridge formed by a punch corner which is contacted by the sheet during pressing. In the implementation shown in FIG. 2, the ridge 7*b* of the punch corner of the punch 7 extends in a direction perpendicular to the direction of transportation of the sheet B. The extension of the ridge 7*b* of a punch corner is generally parallel to the extension of the ridge of a die corner (die shoulder) of the die 6 (i.e., edge of the recess of the die). In the following description, cross section perpendicular to the ridge 7*b* of the punch corner is replaceable with cross section perpendicular to the ridge of the die corner.

In the implementation shown in FIG. 2, a plurality of sheet-thickness measurement devices 10 are provided to correspond to the plurality of punch inner pads 9. Each of the plurality of punch inner pads 9 and the sheet-thickness measurement position for the associated one of the sheet-thickness measurement devices 10 are arranged along a line L1 extending in the direction of transportation. In the implementation shown in FIG. 2, sheet-thickness measurement positions for sheet-thickness measurement devices 10 are provided to correspond to all the punch inner pads 9. The number of punch inner pads 9 may not be equal to the number of sheet-thickness measurement positions for the sheet-thickness measurement devices 10. Sheet-thickness measurement positions for sheet-thickness measurement devices 10 may be provided to correspond to some of the plurality of punch-inner pads 9. Alternatively, a single sheet-thickness measurement device 10 may be constructed to measure sheet thickness at a plurality of positions.

For example, in implementations where the sheet is a differential-thickness metal sheet including a thick portion and a thin portion, the sheet-thickness measurement device(s) 10 may be configured to measure the sheet thicknesses of the thick- and thin portions. In such implementations, a sheet-thickness measurement position on a thick portion and a sheet-thickness measurement position on a thin portion each may be located in a cross section perpendicular to the ridge 7*b* of a punch corner and containing the associated one of the plurality of punch inner pads 9. For example, in the implementation shown in FIG. 2, a plurality of sheet-thickness measurement devices 10 may include those for measurement for thick portions and those for measurement for thin portions.

Further, a measurement position on a thick portion of the sheet B may be located in a cross section containing one punch inner pad 9 of the plurality of punch inner pads 9 (example of the first inner pad) and perpendicular to the ridge 7*b* of a punch corner, whereas a measurement position on a thin portion of the sheet B may be located in a cross section containing another punch inner pad 9 of the plurality of punch inner pads 9 (example of the second inner pad) and perpendicular to the ridge 7*b* of the punch corner.

Figure 3B:
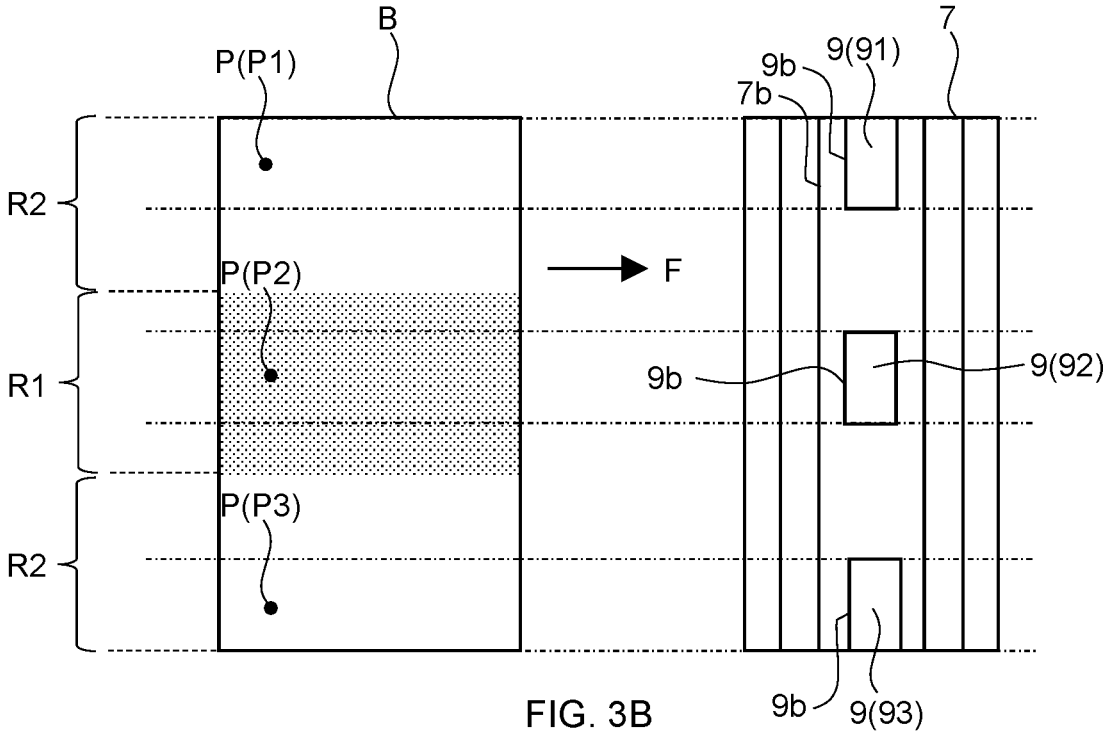
FIG. 3B shows an exemplary arrangement of measurement positions for sheet thickness and punch inner pads employed in implementations where a sheet includes a thick portion and thin portions.

FIG. 3B shows an exemplary arrangement of sheet-thickness measurement positions and the punch inner pads 9, as viewed from above, employed in implementations where the sheet B includes a thick portion R1 and thin portions R2. In FIG. 3B, the region of the sheet B that constitutes the thick portion R1 is indicated by a dotted area. In the implementation shown in FIG. 3B, the sheet-thickness measurement position P2 on the thick portion R1 of the sheet B and one punch inner pad 92 are arranged in the direction of transportation F of the sheet B, whereas the sheet-thickness measurement positions P1 and P3 on the thin portions R2 of the sheet B and other respective punch inner pads 91 and 93 are arranged in the direction of transportation F of the sheet B. In such implementations, the controller 11 controls the amount of stick-out of the punch inner pad 92 from the punch 7 (i.e., initial position) depending on the sheet thickness measured at the measurement position P2 on the thick portion R1. The controller 11 controls the amount of stick-out of each of the punch inner pads 91 and 93 from the punch 7 (i.e., initial position) depending on the wall thickness measured at the respective one of the measurement positions P1 and P3 on the thin portions. This enables setting the amount of stick-out of each of the punch inner pads 91 to 93 from the punch 7 (i.e., initial position) suitable for both the thick- and thin portions R1 and R2.

Further, in implementations where, for example, the sheet is a metal sheet including a high-strength portion and a low-strength portion, the sheet-thickness measurement device(s) 10 may be configured to measure the sheet thicknesses of the high- and low-strength portions. In such implementations, a sheet-thickness measurement position on a high-strength portion and a sheet-thickness measurement position on a low-strength portion may be located in cross sections containing punch inner pads 9 and perpendicular to the ridge 7*b* of the punch corner. For example, in the arrangement shown in FIG. 2, the plurality of sheet-thickness measurement devices 10 may include those for measurement for high-strength portions and those for measurement for low-strength portions. The metal sheet including high and low-strength portions may be, for example, a tailored blank or a locally quenched steel sheet.

Further, a measurement position on a high-strength portion of the sheet B may be located in a cross section containing one punch inner pad 9 of the plurality of punch inner pads 9 (example of the first inner pad) and perpendicular to the ridge 7*b* of the punch corner, whereas a measurement position on a low-strength portion of the sheet B may be located in a cross section containing another punch inner pad 9 of the plurality of the punch inner pads 9 (example of the second inner pad) and perpendicular to the ridge 7*b* of the punch corner.

The arrangement of the measurement positions for sheet thickness in implementations where the sheet B includes high- and low-strength portions and the punch inner pads 9 as viewed from above may be, for example, something similar to the arrangement in FIG. 3B, where the portion R1 is replaced by a high-strength portion and the portions R2 are replaced by low-strength portions. In such implementations, the sheet-thickness measurement position P2 on the high-strength portion R1 of the sheet B and one punch inner pad 92 are arranged in the direction of transportation F of the sheet B, whereas the sheet-thickness measurement positions P1 and P3 on the low-strength portions R2 of the sheet B and other respective punch inner pads 91 and 93 are arranged in the direction of transportation F of the sheet B. In these implementations, the controller 11 controls the amount of stick-out of the punch inner pad 92 from the punch 7 (i.e., initial position) depending on the sheet thickness measured at the measurement position P2 on the high-strength portion R1. The controller 11 controls the amount of stick-out of each of the punch inner pads 91 and 93 from the punch 7 (i.e., initial position) depending on the sheet thickness measured at the respective one of the measurement positions P1 and P3 on the low-strength portions R2. This enables setting the amount of stick-out of each of the punch inner pads 91 to 93 from the punch 7 (i.e., initial position) suitable for both the high- and low-strength portions R1 and R2.

(Exemplary Press-Forming Process)

An exemplary press-forming process using a movable part will now be described. FIGS. 4A to 4D show an exemplary press-forming process. By way of example, an exemplary press-forming process by press equipment including first and second inner pads constituted by punch inner pads 9 will be described. In the implementation shown in FIGS. 4A to 4D, the die pad 8 is positioned inside the die 6 to be movable in the direction in which the sheet is pressed. As used herein, direction in which the sheet is pressed means the direction in which the die 6 moves relative to the punch 7. The punch inner pad 9 is positioned so as to protrude outwardly from the pressing surface 7*a* of the punch 7, and can be pushed in to be at the same height as the pressing surface 7*a* of the punch 7.

Specifically, the die 6 includes, in its inside, a recess 6*a* with a shape corresponding to that of the press-formed product. The punch 7 includes a projection with a shape corresponding to that of the recess 6*a* of the die 6. The top surface of this projection constitutes the pressing surface 7*a* for pressing the sheet B. The punch inner pad 9 is capable of being moved in the vertical direction (i.e., press direction) relative to the punch 7 by means of, for example, a lift mechanism such as a gas spring 9*s* or a cushion mechanism in the press equipment. The die pad 8 is placed, for example, on a slide 6*d* in the press equipment, with a lift mechanism such as a gas spring 8*s* provided therebetween. The die 6 is secured to the slide 6*d*. The die pad 8 is movable in the vertical direction together with the slide 6*d*. The gas spring 8*s* makes the distance between the die pad 8 and slide 6*d* extendable. The bottom of the recess 6*a* of the die 6 includes a hole (not shown) through which the lift mechanism extends. The punch inner pad 9 is located inside a recess formed in the pressing surface 7*a* of the punch 7. The punch inner pad 9 is biased upward by the gas spring 9*s* located inside that recess. Biasing by the gas spring 9*s* makes the top surface of the punch inner pad 9 protrude outwardly from the pressing surface 7*a* of the punch 7. Extension and contraction of the gas spring 9*s* changes the distance between the punch 7 and punch inner pad 9.

With the die pad 8 and punch inner pad 9 being pushed against the sheet B, they are capable of moving relative to the die 6 or punch 7. For example, the die 6 may be moved closer to the punch 7 while the die pad 8 and punch inner pad 9, sandwiching the sheet B, remain stationary. When the die pad 8 and punch inner pad 9 sandwiching the sheet B remain stationary while the slide 6*d*, i.e. die 6, is moving closer to the punch 7, the gas spring 8*s* (i.e., lift mechanism) of the die pad 8 contracts. When the die pad 8 moves closer to the punch 7 while the die 6 is moving closer to the punch 7, the gas spring 8*s* (i.e., lift mechanism) of the die pad 8 does not extend nor contract.

With the punch inner pad 9 protruding outwardly from the pressing surface 7*a* of the punch 7, the press equipment 5 pushes the punch inner pad 9 and die pad 8 against the sheet B and, while keeping this state, moves the die 6 and punch 7 closer to each other to press-form the sheet B. The equipment keeps press-forming the sheet B until the punch inner pad 9 is at the same height as the pressing surface 7*a* of the punch 7, that is, the forming assembly is at the bottom-dead center.

Figure 4A:
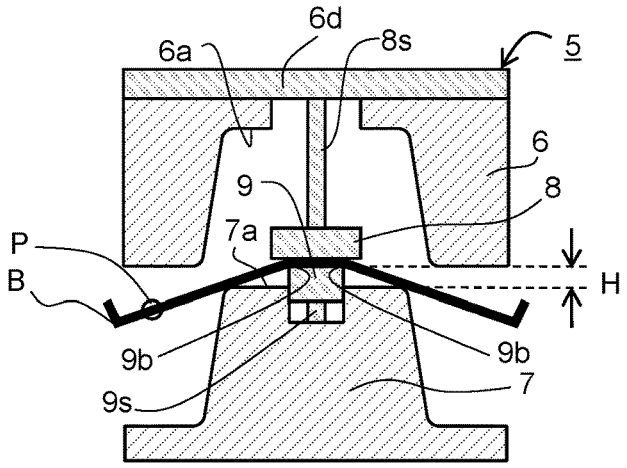
FIG. 4A illustrates an exemplary press-forming process.
Figure 4B:
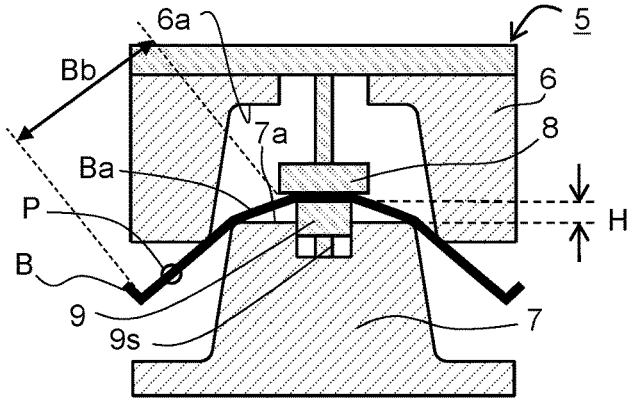
FIG. 4B illustrates the exemplary press-forming process.
Figure 4C:
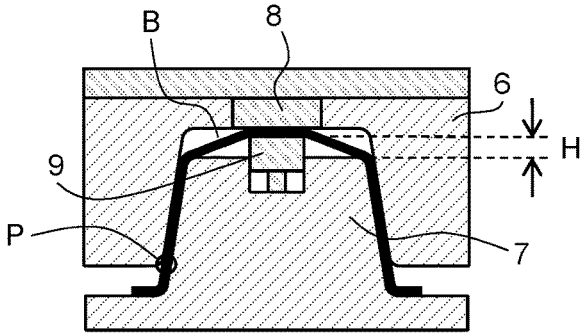
FIG. 4C illustrates the exemplary press-forming process.

More specifically, first, as shown in FIG. 4A, with the punch inner pad 9 protruding outwardly from the pressing surface 7*a* of the punch 7, the die pad 8 is pushed against the sheet B and, with this state being kept, the die 6 and die pad 8 are lowered to press-form the sheet B between the die 6 and punch 7. During this, the position of the punch inner pad 9 relative to the punch 7, i.e., the height of the top surface of the punch inner pad 9 relative to the pressing surface 7*a* of the punch 7 (i.e., amount of protrusion), H, is fixed at a set value (i.e., value of an initial position). The amount of protrusion H is set based on the sheet thickness measured at the measurement position P on the sheet B. The sheet B being formed develops a sag Ba that depends on the height of the top surface (i.e., amount of protrusion) H of the punch inner pad 9 relative to the pressing surface 7*a* of the punch 7. Then, beginning with this state, as shown in FIG. 4B, the die 6 is lowered to continue press-forming while the sag Ba in the sheet B is controlled within a predetermined amount. As shown in FIG. 4C, the die 6 is lowered down to a point directly before the forming bottom-dead center, H (i.e., point distant from the forming bottom-dead center by H). During this, the press mechanism of the die pad 8 contracts while the die 6 is being lowered.

Figure 4D:
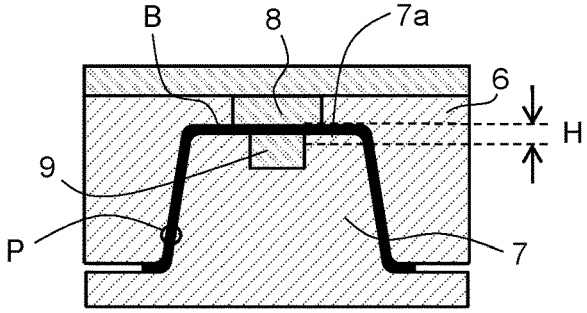
FIG. 4D illustrates the exemplary press-forming process.

During the steps shown in FIGS. 4A to 4C, the die 6 and punch 7 are moved closer to each other while the amount of stick-out, i.e., amount of protrusion, H of the punch 7 from the punch inner pad 9 remains fixed at a set value. At the stage shown in FIG. 4C, where the die pad 8 is in contact with the bottom of the die and thus is completely pulled into the die 6 (i.e., point before the forming bottom-dead center by the amount of protrusion H), the distance between the top surface of the punch inner pad 9 and the pressing surface 7*a* of the punch 7 begins to contract. The position of the punch 7 relative to the punch inner pad 9 changes from the stage of FIG. 4C until the stage of FIG. 4D. As shown in FIG. 4D, the sheet Bis press-formed until the top surface of the punch inner pad 9 is at the same height as the pressing surface 7*a* of the punch 7. During this, the sag Ba in the sheet B, while receiving in plane compressive stress, is forced to flow out toward the vertical walls between the punch 7 and die 6. This results in the press-formed product with a hat-shaped cross section.

In the implementation shown in FIGS. 4A to 4D, the sag Ba developed in the sheet B is crushed and forced to flow toward the vertical walls to increase inwardly bent regions, i.e., regions that contribute to spring-go. This enables balancing spring-back and spring-go in the material being press-formed. This will reduce irregularities in the shape of the vertical walls.

Further, during the press-forming process from FIG. 4A to 4D, the outer portions Bb of the sheet B located outward of the portion sandwiched by the die pad 8 and punch inner pad 9 are pressed while sliding against the die 6 and punch 7. It is preferable that the position P at which sheet thickness has been measured by the sheet-thickness measurement device 10 is included in those portions Bb of the sheet that slide against the die 6 or punch 7 during press-forming. In other words, it is preferable that a sheet-thickness measurement position on the sheet is located in a cross section perpendicular to a ridge of a movable mold part contactable with the sheet during press-forming and containing this ridge, because this ensures that the thickness of a portion of the sheet that affects the shape of the press-formed product more significantly has been measured.

The above exemplary process is a process for press-forming one sheet B, including: with the amount of stick-out of the punch inner pad 9 from the punch 7 being fixed (i.e., under initial press settings), the step of moving the die 6 closer to the punch 7 to press-form the sheet B; and the step of moving the die 6 closer to the punch 7 while changing the amount of stick-out of the punch inner pad 9 from the punch 7, thereby press-forming the sheet B. The amount of stick-out of the punch inner pad 9 from the punch 7, i.e., amount of protrusion H of the punch inner pad 9, under the initial press settings is controlled by the controller 11. The amount of protrusion H is an example of a set amount of stick-out of the punch inner pad from the punch 7 (i.e., initial position of the movable mold part).

The controller 11 decides the amount of protrusion H of the punch inner pad 9 based on the sheet thickness measured at the measurement position P on the sheet B. In the implementation shown in FIGS. 4A to 4D, the measurement position P is included in a cross section containing the ridge 9*b* of a punch inner pad 9 contactable with the sheet B and perpendicular to the ridge 9*b*. This will enable controlling the amount of protrusion H of the punch inner pad 9 depending on the thickness of the portion of the sheet B that is particularly likely to affect the shape of the press-formed product.

The press-forming process using a movable part is not limited to the above exemplary one. For example, the press equipment can be modified by omitting either the die pad 8 or punch inner pad 9. Further, the above exemplary process press-forms a sheet B that is an intermediate material that has been bend-formed in advance; alternatively, the press equipment may press-form a flat sheet that has not been bend-formed.

Typically, for bend-forming, a die pad is often provided to prevent positional displacement of the sheet from the punch inner pad. In other words, in the case of a shape that prevents positional displacement, the die pad may be omitted. The exemplary forming process shown in FIGS. 4A to 4D, too, can be modified by omitting the die pad 8. If the die pad 8 is omitted from the exemplary forming process shown in FIGS. 4A to 4D, from the initial forming stage up to the stage shown in FIG. 4C, the portion corresponding to the die pad 8, pulled into the recess of the die 6, is integral with the die. From the initial forming stage up to the stage shown in FIG. 4C, portions of the sheet B located in the middle as determined in the width direction in a cross section, are raised from below by the punch inner pad 9, as in implementations with the die pad 8, and the press-forming process progresses while keeping that state. After the stage shown in FIG. 4C, the punch inner pad 9 is pushed downwardly by the die 6 and is thus lowered, and the press-forming is completed, as in FIG. 4D.

(Exemplary Press-Formed Product)

Figure 5:
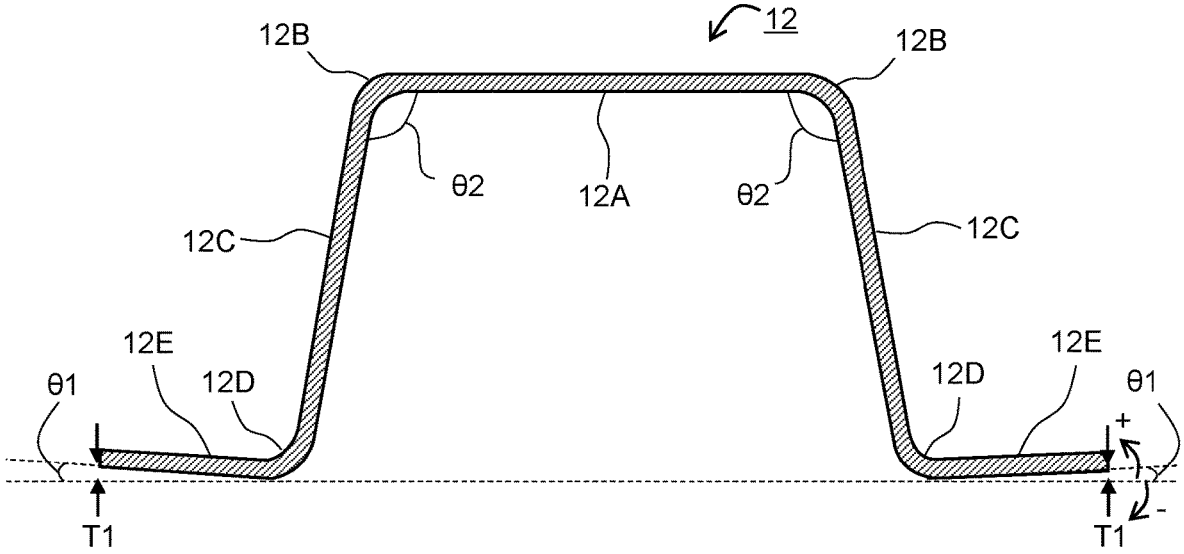
FIG. 5 is a cross-sectional view of an exemplary press-formed product.

FIG. 5 is a cross-sectional view of an exemplary press-formed product. The press-formed product 12 shown in FIG. 5 may be obtained, for example, by the press-forming process shown in FIGS. 4A to 4D. The press-formed product 12 has a hat-shaped cross section. The press-formed product 12 is a long member with its longitudinal direction represented by the direction perpendicular to the cross section shown in FIG. 5. It includes a top plate 12A extending in the width direction of the press-formed product 12, and a pair of ridges 12B adjacent to the two ends, as determined in the width direction, of the top plate 12A. Further, the press-formed product 12 includes a pair of vertical walls 12C extending from the respective ridges 12B in the direction away from the back surface of the top plate 12A (i.e., one sheet-thickness direction), and a pair of ridges 12D adjacent to the ends (i.e. lower ends) of the pair of vertical walls 12C. Furthermore, the press-formed product 12 includes a pair of flanges 12E extending from the respective ridges 12D in the respective width directions of the top plate 12A. The angle formed by the top plate 12A and vertical walls 12C, 02, is not limited to 90 degrees. An exemplary range of the angle θ2 may be 90 to 125 degrees. During high deformation with this range, problems such as spring-back become particularly significant; thus, the above-discussed feedback control will be advantageous. An acute angle θ2, below 90 degrees, may cause problems with removal of the press-formed product from the mold.

In the press-formed product 12, the angle θ1 formed by the top plate 12A and a flange 12E, for example, may be measured. In this implementation, spring-back occurs when each angle θ1, formed by the top plate 12A and a flange 12E, is larger than a predetermined reference value θc indicating the desired shape, i.e., 0 degrees in this case (θ1>θc (=0 degrees)), and spring-go occurs when θ1 is smaller than the reference angle θc (θ1<θc (=0 degrees)). The value indicating the degree of spring-back or spring-go is not limited to the angle θ1 of the above implementation. For example, the angle formed by the top plate 12A and a flange 12E, θ2, or the height difference in the bottom surface of a flange 12E as measured in the vertical direction, T1, may be measured to provide a value for indicating the degree of spring-back or spring-go.

(Exemplary Operation)

Figure 6:
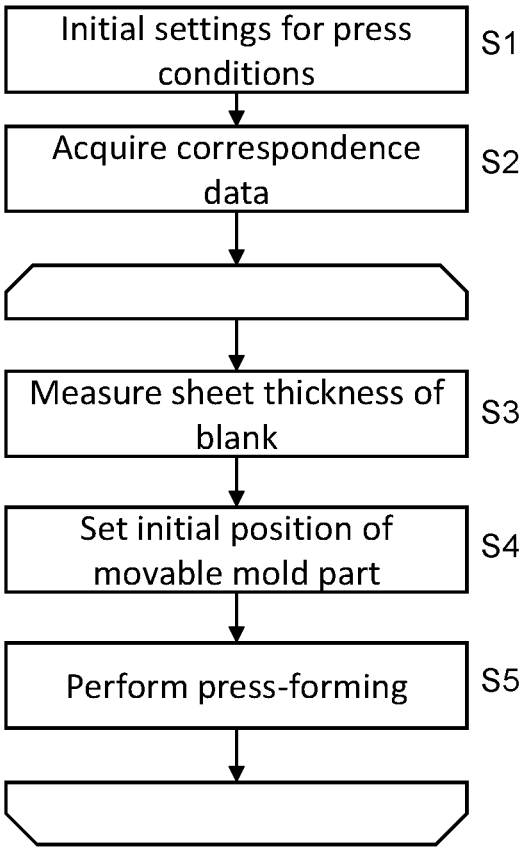
FIG. 6 is a flow chart illustrating an exemplary operation of the controller.

FIG. 6 is a flow chart illustrating an exemplary operation of the controller 11 according to the present embodiment. In the implementation shown in FIG. 6, first, the controller 11 makes initial settings for press conditions (S1). The press conditions include, for example, the position of the movable part relative to the die or punch. By way of example, the controller sets the initial value of the amount of protrusion H of the punch inner pad 9, discussed above. The press conditions are not limited to the relative position of the movable part.

The controller 11 acquires correspondence data that has been provided by calculation in advance (S2). For example, the controller 11 determines the correspondence data to be used for the feedback process and makes it accessible. For example, the computer of the controller 11 extracts correspondence data to be used for the process from the data that has been stored in advance on a storage medium accessible to itself (i.e., storage device incorporated in the controller 11 or an external one), and stores it on memory (i.e., storage device 11*b*). The correspondence data is created in advance prior to press-forming, and is stored on a storage medium accessible to the controller 11.

Figure 7:
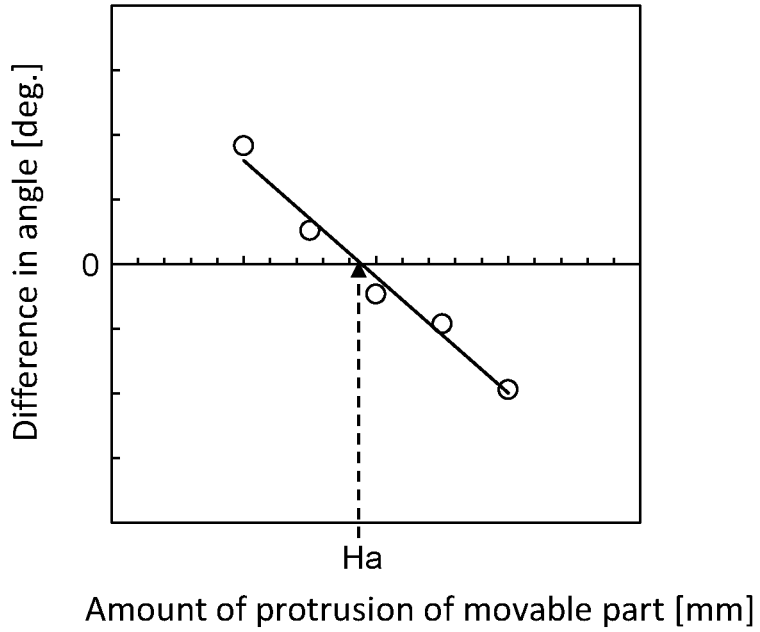
FIG. 7 is a graph illustrating an exemplary correlation between the amount of protrusion of a movable part and the shape of a press-formed product.

Exemplary correspondence data will be described below. FIG. 7 is a graph illustrating an exemplary relationship between the shape of a press-formed product and the amount of protrusion H of the punch inner pad 9. The graph shown in FIG. 7 illustrates the relationship between the amount of protrusion H of the punch inner pad 9 and spring-back/spring-go. The difference in angle, represented by the vertical axis of the graph, indicates the difference between the angle θ1 formed by the top plate 12A and a flange 12E of the press-formed product 12 shown in FIG. 5, on one hand, and the reference value θc, i.e., 0 degrees in this case (θ1−θc (θc=0 degrees in this case)). The reference value θc is the angle formed by the top plate and a flange 12E when there is no spring-back nor spring-go. A positive difference in angle means spring-back, while a negative difference in angle means spring-go. In the relationship illustrated by the graph of FIG. 7, the appropriate value Ha of the amount of protrusion of the punch inner pad is the amount of protrusion for a difference in angle of zero.

Figure 8:
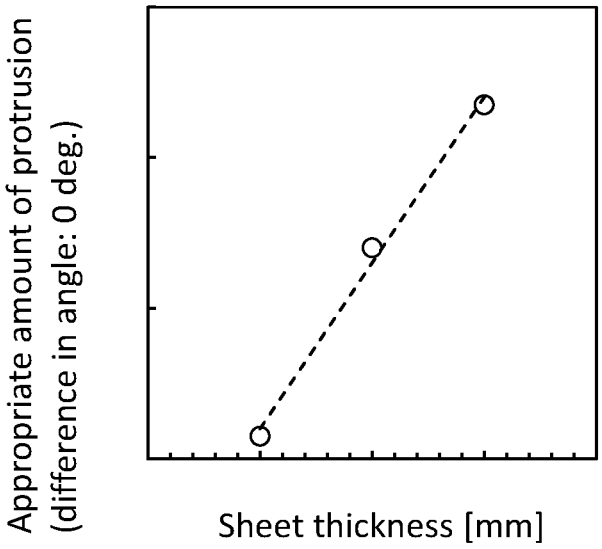
FIG. 8 is a graph illustrating an exemplary relationship between the appropriate amount of protrusion of a movable part and sheet thickness.

FIG. 8 is a graph illustrating an exemplary relationship between the appropriate amount of protrusion and the sheet thickness of a sheet. The vertical axis of the graph shown in FIG. 8 represents the amount of protrusion of the punch inner pad encountered when the difference in angle (θ1−θc) is zero, that is, when there is no spring-back nor spring-go. The inventors have found that, as shown in FIG. 8, there is a correlation between the sheet thickness of a sheet and the appropriate amount of protrusion of the punch inner pad. The controller 11 uses correspondence data indicating such correlation to determine the appropriate amount of protrusion based on the sheet thickness of the sheet that has been measured. For example, an equation expressing the line in the graph shown in FIG. 8 or data indicating the plotted circles in the graph may be treated as correspondence data.

At S3 of FIG. 6, the sheet-thickness measurement device 10 measures the sheet thickness of the sheet B that is to be transported next to the movable mold part. The controller 11 acquires the measurement of the sheet thickness of the sheet from the sheet-thickness measurement device 10. By way of example, as shown in FIG. 2, sheet thickness is measured at the measurement position P on the sheet B at a location that is upstream of each punch inner pad 9 as determined along the direction of transportation.

The controller 11 sets the position of the punch inner pad 9 relative to the punch (i.e., initial position), such as the amount of protrusion H, based on the sheet thickness of the sheet measured at S3 (S4). The controller 11 controls the press equipment 5 to adjust the amount of protrusion H of the punch inner pad 9 relative to the punch 7 to the value that has been set based on the sheet thickness. The controller 11 performs press-forming while controlling the amount of protrusion H (S5). At S5, the sheet for which sheet thickness has been measured at S3 is subjected to press-forming with the amount of stick-out (i.e., amount of protrusion H) of the punch inner pad 9 set at S4.

The process from S3 to S5 in FIG. 6 is repeated for each of a plurality of sheets contained in one manufacture lot. Thus, for each sheet to be press-formed in one manufacture lot, feedforward control is possible based on the sheet thickness of the sheet.

(Exemplary Sheet Material)

The sheet to which the present invention is applicable is not limited to any particular material. The material of the sheet used may be, for example, a thin sheet format by a 980 MPa grade high-strength steel sheet (high-tensile-strength steel sheet). In recent years, press-formed products with higher and higher strengths have been developed to reduce the weight of press-formed products. Together with this, materials of press-formed products with higher and higher strengths have been developed, too. A material with a higher strength is more difficult to press-form into a desired shape. For example, in general, the higher the strength of a material, the stronger spring-back occurs. The above embodiment reduces the deviations of the shapes of a plurality of press-formed products from a target shape or variations therein even with a sheet having a tensile strength of 980 MPa or higher.

Further, in general, when a steel sheet with a tensile strength of the 270 MPa grade and a 1.2 GPa-grade steel sheet are compared, for example, the 1.2 GPa-grade steel sheet generally tends to have larger variations in sheet thickness. Regardless of how the mold shape is adjusted such that the first press-formed product to be press-formed from a manufacture lot has a desired shape, the possibility of press-formed products that are subsequently press-formed from this manufacture lot not having the desired shape is high if there are large variations in sheet thickness. According to the above embodiment, even if a sheet is used having a tensile strength of 980 MPa or higher, which experiences relatively large variations in material characteristics compared with a steel sheet with low strength, feedforward control of the relative position of the movable part depending on the sheet thickness reduces variations in shape among a plurality of press-formed products.

EXAMPLES

Figure 9:
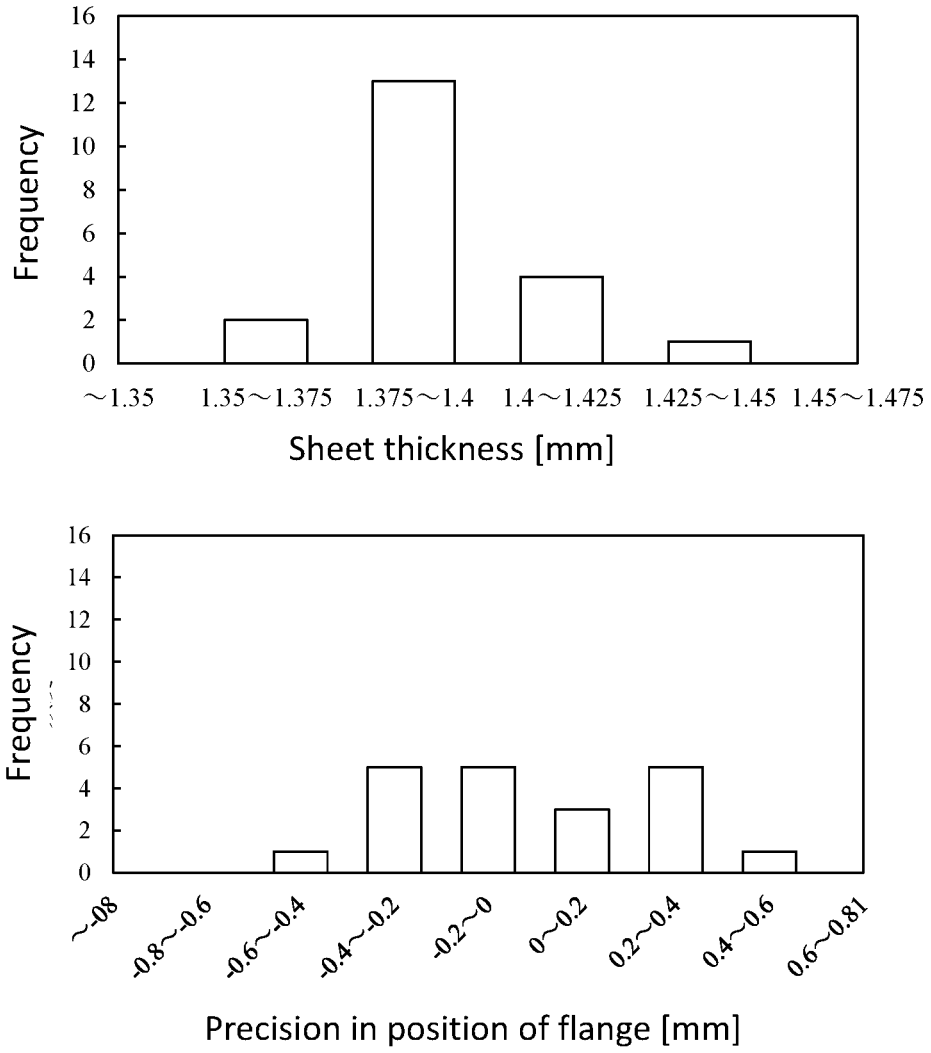
FIG. 9 shows graphs illustrating sheet thickness, the amount of protrusion, and the precision in the position of a flange in implementations where no feedforward control based on sheet thickness is performed.
Figure 10:
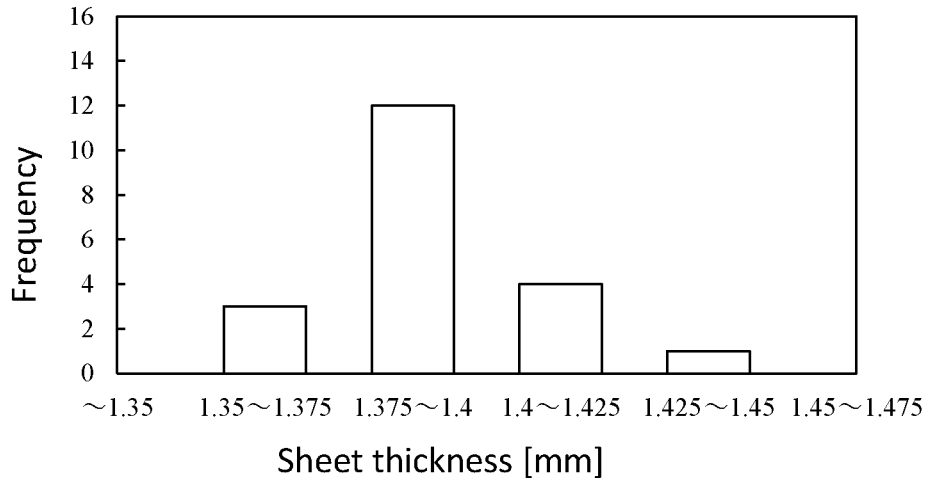
FIG. 10 shows graphs illustrating sheet thickness, the amount of protrusion, and the precision in the position of a flange in implementations where feedforward control based on sheet thickness is performed.
Figure 10:
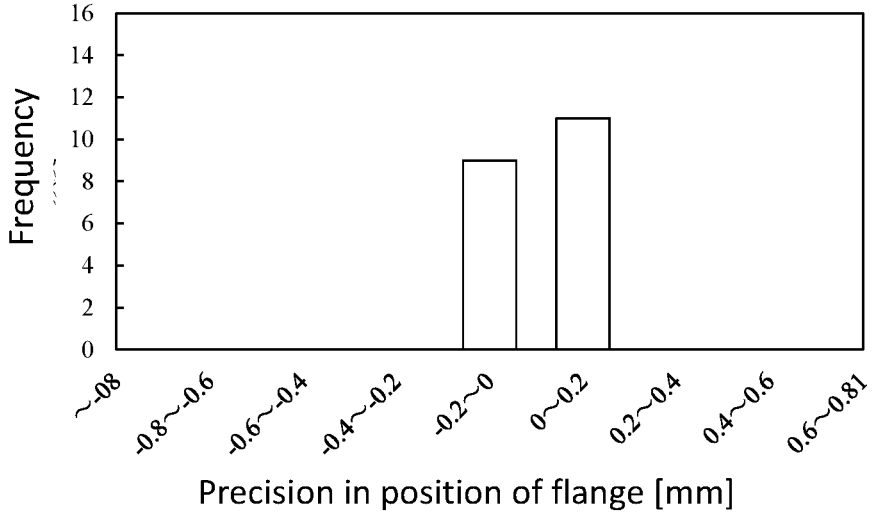

FIG. 9 shows histograms showing measurements of the precision in the position of a flange without feedforward control of the amount of protrusion H of the punch inner pad 9 depending on the sheet thickness of the sheet. FIG. 10 shows histograms showing measurements of the precision in the position of a flange with feedforward control of the amount of protrusion H of the punch inner pad 9 depending on the sheet thickness of the sheet. In each of FIGS. 9 and 10, the upper histogram shows the sheet-thickness distribution for the sheets contained in one test lot. The sheet thickness of a sheet is randomly changed for each shot of press-forming within the range of approximately 0.1 mm. The lower histogram shows the distribution of the precision in the position of a flange for one test lot. The precision in the position of a flange is the difference in the height of a flange (corresponding to T1 shown in FIG. 5). The precision in the position of a flange is expressed where the reference position that serves as the target is 0.0. The material of the sheets used was a steel sheet with a tensile strength of 1180 MPa.

For the examples shown in FIG. 9 with variations in the sheet thickness of a sheet in the range of approximately 0.1 mm, the standard deviation of the precision in the position of a flange was 0.25 mm. On the other hand, for the examples shown in FIG. 10 with variations in the sheet thickness of a sheet in the range of approximately 0.1 mm, the standard deviation of the precision in the position of a flange was 0.11 mm. Further, the average precision in the position of a flange was about 0.01 mm for each case. These results demonstrate that feedforward control that controls the amount of protrusion H of the punch inner pad 9 depending on the sheet thickness of the sheet reduces the deviation of the shape of a press-formed product from a target shape and variations therein.

Although an embodiment of the present invention has been described, the above-described embodiment is provided merely by way of example to enable carrying out the present invention. Accordingly, the present invention is not limited to the above-described embodiment, and the above-describe embodiment, when carried out, can be modified appropriately without departing from the spirit of the invention.

For example, according to the above embodiment, the movable mold part for which the initial position is controlled depending on sheet thickness is an inner pad of a punch; alternatively, the initial position of a die pad provided on the die relative to the die may be controlled depending on sheet thickness.

The above embodiment describes an implementation in which a plurality of positions on one sheet are measured by describing the measurement of the sheet thicknesses of a thick portion and a thin portion of one sheet, or those of a high-strength portion and a low-strength portion of one sheet. The sheet-thickness measurement for a plurality of positions on one sheet is not limited to these implementations. For example, the sheet thicknesses of a sheet may be measured at a plurality of positions within a region for measurement, and a value based on the sheet thicknesses for these positions (e.g., average) may be treated as the sheet thickness for the region for measurement.

According to the above embodiment, the sheet-thickness capturing device for capturing sheet thickness is a sheet-thickness measurement device. The sheet-thickness capturing device may be a device that acquires data indicating the sheet thicknesses of a plurality of sheets B to be pressed. For example, in implementations where a sheet-thickness measurement device is remotely located, the sheet-thickness capturing device may be configured to receive data indicating sheet thickness from the sheet-thickness measurement device or another communication device. The sheet-thickness capturing device may be included in the controller. That is, the controller may be configured to capture sheet thickness from an external device. The data indicating the sheet thicknesses of individual sheets is preferably data containing actual measurements of sheet thickness; however, the data indicating sheet thickness is not limited to data containing actual measurements.

EXPLANATION OF CHARACTERS

4: transportation device
5: press equipment
6: die
7: punch
8: die pads
9: punch inner pads (first and second inner pads)
10: sheet-thickness measurement device
11: controller
12: press-formed product

The invention claimed is:

1. A method of manufacturing a press-formed product, comprising:

capturing, via a sheet-thickness capturing device, a sheet thickness of one or more sheets to be pressed separately for each sheet; and press-forming the sheet into a press-formed product using a die, a punch and a movable mold part, the movable mold part being capable of changing its position relative to both the die and the punch, the movable mold part capable of protruding outwardly from a pressing surface of the die or the pressing surface of the punch, and the die, the punch, and the movable mold part performing the press-forming of the sheet into the press-formed product, wherein, the press-forming of the sheet into the press-formed product includes controlling an initial position of the movable mold part relative to the die or the punch using and depending on the captured sheet thickness of the sheet, and wherein the sheet-thickness of the sheet is captured prior to performing the press-forming the sheet by the press equipment.

2. The method of manufacturing a press-formed product according to claim 1, wherein the press-forming includes successively press-forming a plurality of sheets, and, during at least one of the plurality of successive press-forming cycles, the initial position of the movable mold part relative to the die or the punch is controlled depending on the sheet thickness of the sheet.

3. The method of manufacturing a press-formed product according to claim 1, wherein the capturing of the sheet thickness includes capturing sheet thicknesses at a plurality of positions on one sheet, and, during the press-forming of the one sheet, the initial position of the movable mold part relative to the die or the punch is controlled depending on the sheet thicknesses at the plurality of positions on the one sheet.

4. The method of manufacturing a press-formed product according to claim 3, wherein the movable mold part includes a plurality of movable mold parts capable of changing their positions independently from each other, the capturing of the sheet thickness includes capturing sheet thicknesses at a plurality of positions on one sheet corresponding to the plurality of movable mold parts, and, during the press-forming of the one sheet, the initial positions of the plurality of movable mold parts are controlled depending on the sheet thicknesses of the one sheet at the corresponding ones of the plurality of positions.

5. The method of manufacturing a press-formed product according to claim 1, wherein, during the press-forming, a portion of the sheet for which the sheet thickness has been measured slides against the die.

6. The method of manufacturing a press-formed product according to claim 5, wherein the movable mold part includes a first inner pad provided on a top of the punch, and a position on the sheet for which the sheet thickness has been measured is located in a cross section perpendicular to a ridge of a punch corner of the punch, the cross-section containing the first inner pad during the press-forming.

7. The method of manufacturing a press-formed product according to claim 5, wherein the movable mold part includes a first inner pad and a second inner pad provided on a top of the punch, the sheet is a differential-thickness metal sheet including a thick portion and a thin portion having a smaller sheet thickness than the thick portion, the capturing of the sheet thickness of the sheet includes capturing a sheet thickness of the thick portion and a sheet thickness of the thin portion, a position on the thick portion for which sheet thickness has been captured is located in a cross section perpendicular to a ridge of a punch corner of the punch and containing the first inner pad during the press-forming, a position on the thin portion for which sheet thickness has been captured is located in a cross section perpendicular to the ridge of the punch corner and containing the second inner pad during the press-forming, and during the press-forming, the initial position of the first inner pad relative to the punch is controlled depending on the sheet thickness of the thick portion, and the initial position of the second inner pad relative to the punch is controlled depending on the sheet thickness of the thin portion.

8. The method of manufacturing a press-formed product according to claim 5, wherein the movable mold part includes a first inner pad and a second inner pad provided on a top of the punch, the sheet includes a high-strength portion and a low-strength portion having a lower strength than the high-strength portion, the capturing of the sheet thickness of the sheet includes capturing a sheet thickness of the high-strength portion and a sheet thickness of the low-strength portion, the punch includes the second inner pad, a position on the sheet for which a sheet thickness of the high-strength portion has been captured is located in a cross section perpendicular to a ridge of a punch corner of the punch and containing the first inner pad during the press-forming, a position on the sheet for which a sheet thickness of the low-strength portion has been captured is located in a cross section perpendicular to the ridge of the punch corner and containing the second inner pad during the press-forming, and, during the press-forming, the initial position of the first inner pad relative to the punch is controlled depending on the sheet thickness of the high-strength portion, and the initial position of the second inner pad relative to the punch is controlled depending on the sheet thickness of the low-strength portion.

9. The method of manufacturing a press-formed product according to claim 1, wherein the press-forming includes:

a first press step in which, with a position of the movable mold part relative to the die or the punch being fixed to the initial position, the die and the punch are moved closer to each other to press-form the sheet; and a second press step in which, while the movable mold part is being pulled into the die or the punch, the die and the punch are moved closer to each other to press-form the sheet, wherein, during the press-forming, the initial position of the movable mold part is controlled depending on the sheet thickness of the sheet.

10. The method of manufacturing a press-formed product according to claim 1, wherein a portion of the sheet with the highest strength has a tensile strength not lower than 980 MPa.

11. The method of manufacturing a press-formed product according to claim 1, wherein the sheet-thickness of the sheet is captured prior to positioning the sheet on the die, the punch, or the movable mold part for press-forming.

12. A press line comprising:

a sheet-thickness capturing device configured to capture a sheet thickness of one or more sheets to be pressed separately for each sheet, press equipment including a die, a punch and a movable mold part capable of moving relative to both the punch and the die, the movable mold part capable of protruding outwardly from a pressing surface of the die or the pressing surface of the punch, and the die, the punch, and the movable mold part performing the press-forming of the sheet into the press-formed product; and a controller configured to control the press equipment, wherein the controller is configured, during press-forming of the sheet by the die, the punch and the movable mold part, to control an initial position of the movable mold part relative to the die or the punch using and depending on the sheet thickness of the sheet captured by the sheet-thickness capturing device, and wherein the sheet-thickness of the sheet is captured prior to performing the press-forming the sheet by the press equipment.

13. The press line according to claim 12, wherein the sheet-thickness capturing device is a sheet-thickness measurement device configured to measure the sheet thickness of the sheet.

14. The press line according to claim 13, wherein a position on the sheet for which the sheet thickness is measured by the sheet-thickness measurement device is located in a plane perpendicular to a ridge of a punch corner of the punch, the cross section containing the movable mold part.

15. The press line according to claim 13, further comprising:

a transportation device capable of transporting the sheet to be pressed from the sheet-thickness measurement device to the press equipment, wherein the movable mold part and the sheet-thickness measurement device are located on a line extending in a direction of transportation of the transportation device.

16. The press line according to claim 15, wherein the sheet-thickness measurement device is configured to measure sheet thicknesses at a first position and a second position, the movable mold part includes a first inner pad and a second inner pad provided on a top of the punch, the first inner pad and the first position are located on a line extending in the direction of transportation of the transportation device, and the second inner pad and the second position are located on a line extending in the direction of transportation of the transportation device.

* * * * *